United States Patent [19]

Juday

[11] Patent Number: 4,479,986

[45] Date of Patent: Oct. 30, 1984

[54] IMPREGNATION OF METAL CASTINGS

[75] Inventor: Thomas W. Juday, New Berlin, Wis.

[73] Assignee: Imprex, Inc., Milwaukee, Wis.

[21] Appl. No.: 502,835

[22] Filed: Jun. 9, 1983

[51] Int. Cl.[3] ..... B05D 3/00; C23C 13/08

[52] U.S. Cl. ..... 427/295; 118/50

[58] Field of Search ..... 118/50; 427/295

[56] References Cited

U.S. PATENT DOCUMENTS 4,311,735 1/1982 Young ..... 118/50 X 4,384,014 5/1983 Young ..... 118/50 X

*Primary Examiner*—Michael R. Lusignan

*Attorney, Agent, or Firm*—Quarles & Brady

[57] ABSTRACT

An apparatus (2) for the impregnation of metal castings including an impregnation chamber (11) having an open end; a movable assembly (2) comprising a cover (20) for closing the open end of the impregnation chamber, a casting carrier (21), carrier transport means (22) for raising and lowering the casting carrier relative to the cover, and carrier rotating means (23); and transport means (24) for raising and lowering the movable assembly relative to the open end of the impregnation chamber. The impregnation chamber is partially filled with liquid sealant (30). The apparatus is operated to position the carrier in the impregnation chamber above the liquid sealant therein and develop a vacuum in the chamber, submerge the carrier (and castings therein) in the sealant, and then raise the carrier above the sealant level and rotate carrier to spin-off excess liquid sealant; the movable assembly is thereafter raised to unload impregnated castings.

12 Claims, 7 Drawing Figures

IMPREGNATION OF METAL CASTINGS

FIELD OF THE INVENTION

This invention relates to apparatus and method for the impregnation of metal castings with a liquid sealant for sealing pores in the castings.

BACKGROUND ART

A wide variety of articles are manufactured by casting various metals, e.g. cast iron, aluminum, brass, magnesium, bronze, etc., such as engine blocks, engine heads, valve bodies, pipe fittings, carburetor bodies and the like. With any of the metal casting processes in general use, it is typical for a minor proportion of the articles to have pores that extend through or partially through a wall of the casting. Because these pores can impair the usefulness of the cast article, such as by resulting in gaseous or fluid leakage, the art of impregnating castings to fill the pores has developed in order that the castings can be made suitable for their intended use instead of being scrapped.

A commonly practiced technology for impregnation of metal castings includes the steps of submerging the castings in a bath of liquid sealant in an enclosed impregnation tank, and then evacuating the tank to a sufficiently low vacuum to enable air entrapped in any pores in the castings to escape so that the pores can be filled with liquid sealant. The vacuum in the impregnating tank is then released and the castings are transferred to a tank in which the excess sealant is allowed to drain off. The castings are transferred to another tank in which they are rinsed with water and/or detergent in order to wash off excess sealant. Next, the castings are transferred to a curing vessel to allow the sealant to cure to a solid material to fill the pores in a casting, which generally involves a thermal curing with the use of heated oil or water.

Many types of thermosetting resin compositions are used as liquid sealants for vacuum impregnation of metal castings. Unsaturated polyesters, often incorporating low viscosity monomers such as styrene inhibitors and catalysts, may be employed. Sodium silicate sealant compositions are also used. Other thermosetting liquid sealant compositions include monofunctional and polyfunctional acrylate monomers, generally mixed with a catalyst and inhibitor. The sealant may be curable under anaerobic conditions or oxygen-containing conditions. Representative patents disclosing liquid sealant compositions include British Pat. Nos. 1,297,103 and 1,308,947, and U.S. Pat. Nos. 2,554,254, 2,932,583, 3,345,205, 4,069,378 and 4,147,821.

A major impregnation technique practiced at this time is the "wet vacuum" process in which a casting is first submerged in liquid sealant in an impregnation tank, and thereafter a suitable vacuum is developed in the tank. There have been proposals to employ a "dry vacuum" impregnation step in which the castings are placed in a closed impregnation tank and subjected to a vacuum, after which liquid sealant is transferred from a reservoir into the tank for filling the pores in the castings. See for example, U.S. Pat. Nos. 2,932,583, 3,345,205 and 4,311,735. Equipment for single tank dry vacuum impregnation of sintered articles was sold for a time by American Metaseal. However, no commercial use of single tank dry vacuum impregnation for metal castings is known to the present inventor as of the filing date hereof, and it is believed this is due to the unavailability of equipment suitable for its practice.

My present invention relates to a dry vacuum single tank metal casting impregnation system. The principal objectives of the development of this invention were: the provision of a dry vacuum impregnation system which is believed to be practical for commercial use; the development of an impregnation apparatus that will enable efficient practice of dry vacuum impregnation of metal castings; the provision of an impregnation apparatus that will offer economies as to capital investment and operating costs; the provision of an impregnation system suitable for in-line arrangement of the several required pieces of equipment; the provision of an impregnation apparatus which can be readily combined with material handling equipment; considerable reduction of the time required for the actual impregnation process; and provision for spin-off of excess resin from the castings while in the impregnation apparatus.

DISCLOSURE OF THE INVENTION

The present invention provides an apparatus for impregnating metal castings with liquid sealant comprising (1) a support member, (2) an impregnation chamber having an open end, and (3) a movable assembly which travels along the support member and includes (a) a cover means for closing the open end of the impregnation chamber, (b) a casting carrier, (c) assembly transport means for reciprocating the movable assembly between a first position in which the impregnation chamber is open and a second position in which the impregnation chamber is closed, and (d) carrier transport means for reciprocating the casting carrier between a first position in which the carrier is adjacent to the cover means and located above the liquid level of sealant in the impregnation chamber and a second position in which the carrier is remote from the cover and submerged in sealant in the impregnation chamber, the carrier transport means also being adapted to rotate the casting carrier while in its first position.

The present invention also provides a method for impregnating castings with liquid sealant utilizing an impregnation apparatus of the type described above by filling an impregnation chamber partially full with liquid sealant to provide a space above the liquid level thereof, positioning castings in an initial position inside the chamber above the liquid level of the sealant and applying vacuum to the chamber while the castings are in such position, submerging the castings in the liquid sealant, returning the castings to their initial position above the liquid sealant and rotating the castings to spin-off excess sealant, and thereafter removing the castings from the impregnation chamber for transfer to subsequent rinse and curing stations, or other stations tyically associated with the impregnation of metal castings.

BRIEF DESCRIPTION OF THE DRAWINGS

The present invention is described hereinbelow in the full and concise terms required under 35 U.S.C. Sec. 112 by reference to the following drawings, in which.

BEST MODES FOR CARRYING OUT THE INVENTION

(a) General Description

Figure 1:
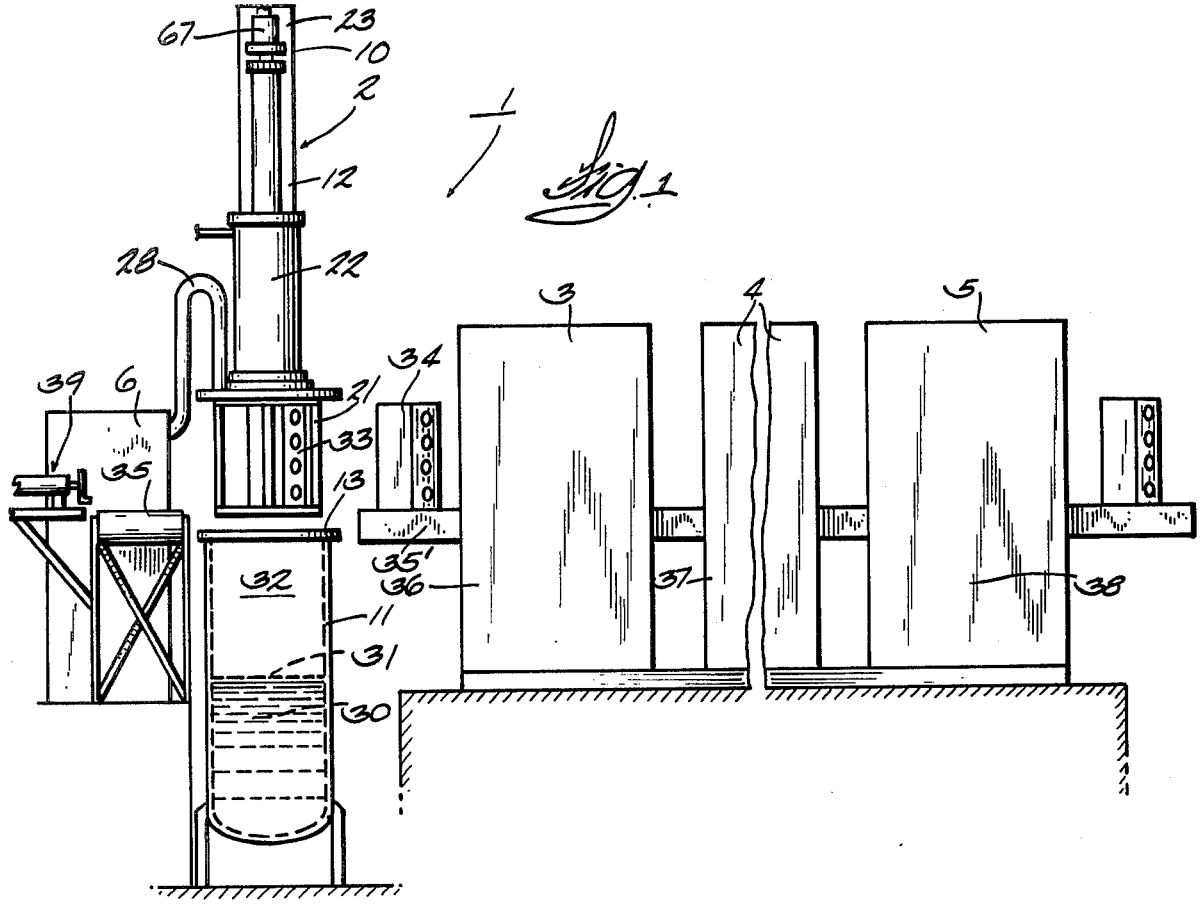
FIG. 1 is a side view, with portions broken away, of a complete impregnation system incorporating the present invention.

FIG. 1 illustrates a complete impregnation system indicated by the general reference numeral 1 which comprises an impregnation apparatus 2, rinse station 3, cure station 4, cooling station 5, and a vacuum pump 6.

The impregnation apparatus 2 of the system 1 is constructed according to the present invention and includes a fixed vertical support member 10, a fixed impregnation chamber 11 and a movable assembly 12. The impregnation apparatus 2 is also shown in the sequential views of FIGS. 2-4, and the following description is made with reference to FIGS. 1-4.

The impregnation chamber 11 is illustrated as a tank having an open top 13 and a closed bottom. It is fixed in place relative to the vertical support 10 and may be connected therewith by brackets 14. The vessel 11 can be of any selected shape, such as a cylindrical tank as illustrated in the drawings, or a rectangular or square tank.

Figure 2:
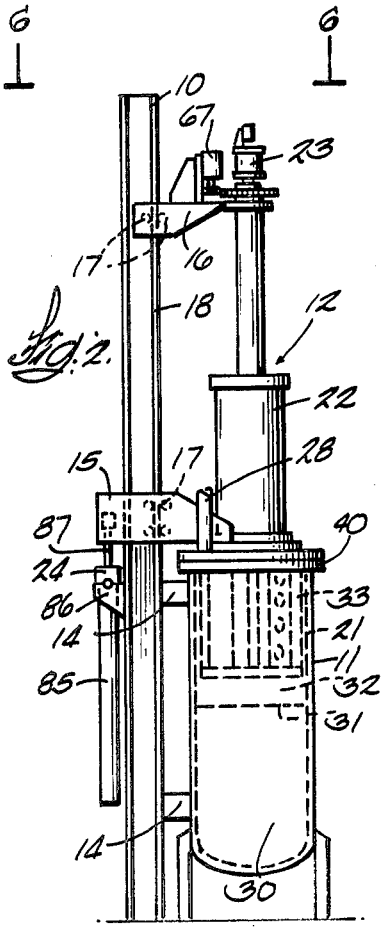
FIGS. 2, 3 and 4 are schematic side views illustrating a sequence of steps in the operation of the new impregnation apparatus of this invention.
Figure 3:
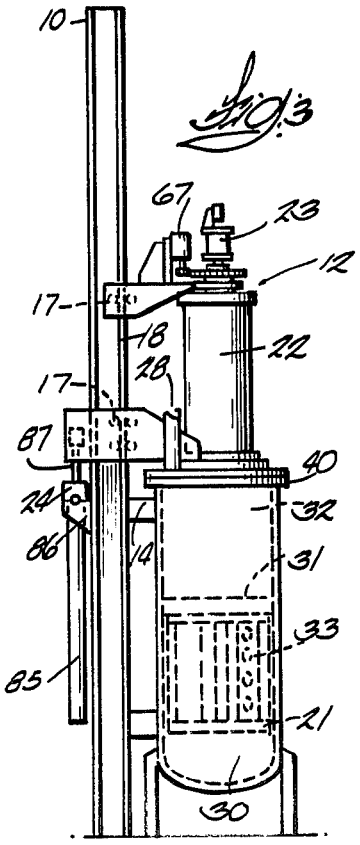
Figure 4:
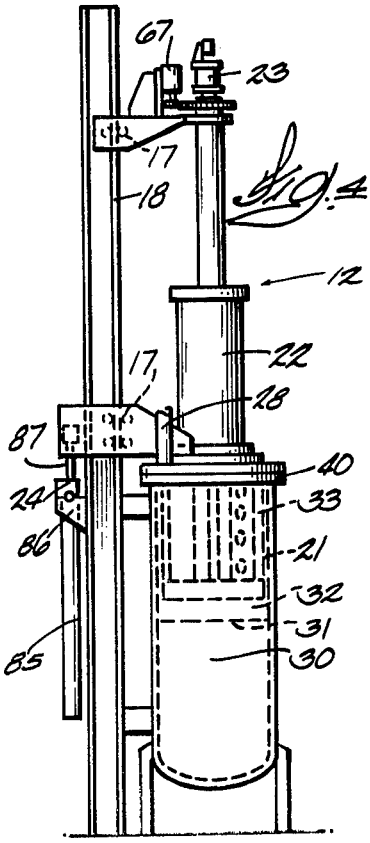
Figure 6:
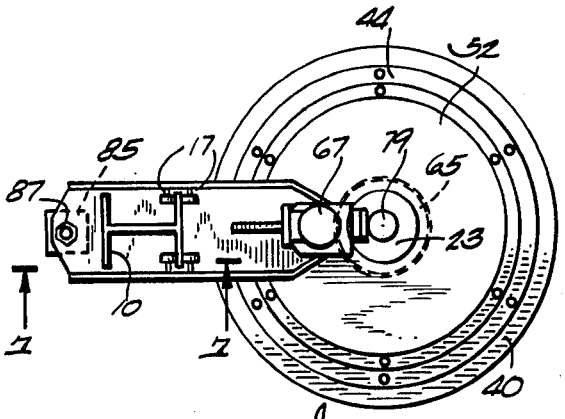
FIG. 6 is a top view, partly in section, taken along the plane of line 6—6 of FIG. 2.
Figure 7:
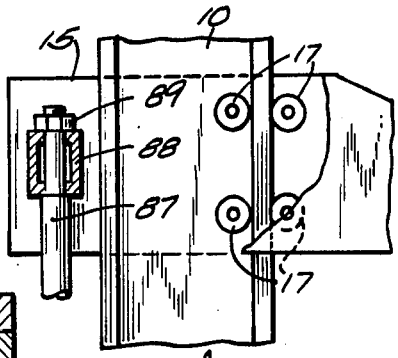
FIG. 7 is a partial side view, partly in section, taken along the plane of lines 7—7 of FIG. 6.

The movable assembly 12 of the impregnation apparatus 2 is supported by lower carriage 15 and upper carriage 16 which ride on rollers 17 along the inner flange 18 of the vertical support 10 that is illustrated herein as an I-beam, see especially FIGS. 2-4. This arrangement permits reciprocating movement of the movable assembly along the vertical support 10. The principal elements of the movable assembly 12 are cover means 20 which is large enough in size to cover the open end 13 of the impregnation chamber 12, casting carrier 21 which is underneath the cover means 20 in the illustrative embodiment, carrier transport means 22 for moving the casting carrier 21 between a first position as illustrated in FIGS. 2 and 4 in which it is located adjacent the cover means 20 and a second position as illustrated in FIG. 3 in which it is located remote from the cover means, and carrier rotating means 23 adapted for rotating the casting carrier 21. Assembly transport means 24 is provided for raising and lowering the movable assembly 12 between the open position of FIG. 1 in which the impregnation chamber is open and the closed position shown in FIGS. 2-4 in which the impregnation chamber is closed. These elements, and others, will be described in greater detail hereinbelow in reference to FIGS. 5-7.

The vacuum pump 6 (see FIG. 1) is connected through flexible vacuum line 28 to a fitting 29 (FIG. 5) that extends through the cover means 20 of the movable assembly so as to communicate with the interior of the impregnation chamber 11. The vacuum pump, of which many suitable types are commercially available and is illustrated herein schematically, should be capable of developing a vacuum of from about 1 to 10 Torrs for most uses of the impregnation apparatus.

The operation of the impregnation system 1 is as follows:

(1) Load step. Referring first to FIG. 1, the assembly transport means 24 is activated to raise the movable assembly 12 to a first or raised position in which the carrier 21 is clear of the impregnation chamber 11 and the top end 13 of the chamber is open. The impregnation chamber is partially filled with liquid sealant 30 which has a liquid level 31 intermediate the top and bottom of the chamber 11 so as to leave a space 32 large enough to accommodate the carrier 21. When the carrier 21 is in its first position of FIG. 1, one or more castings 33, herein represented as a cast metal engine block, can be placed onto the carrier 21; this can be accomplished manually, but is preferably carried out with suitable automatic material handling equipment, not shown, which may supply castings onto a feed conveyor 35 alongside the carrier and an article transfer means 39 to transfer castings onto the carrier.

(2) Dry vacuum step. The assembly transport means 24 is activated to lower the movable assembly 12 to a second or lowered position as illustrated in FIG. 2 wherein the cover means 20 closes the open end 13 of the impregnation chamber 11. In this position, the casting carrier 21 is in a first position above the level 31 of the sealant 30 and within the space 32 of the chamber 11 and the casting 33 does not contact any of the sealant 30. After the impregnation chamber has been closed in this fashion, the vacuum pump 6 is actuated so as to develop a suitable vacuum within the chamber 11, which has the effect of causing air entrapped within pores in the casting 33 to be purged therefrom.

(3) Impregnation step. Upon completion of step (2), the carrier transport means 22 is activated to lower the casting carrier 21 into the liquid sealant 30 to its second position illustrated in FIG. 3. The casting 33 is thus completely submerged within the sealant 30, and held therein for a sufficient period of time to allow for any pores in the casting to be filled with sealant, during which time the vacuum developed during step (2) may or may not be continued. Also, if so desired, pressure may be applied to the interior of the impregnation chamber 11 during this phase of the operation. Upon completion of this step, any vacuum or pressure developed in the chamber is released to atmospheric pressure.

(4) Spin-off step. Upon the completion of step (3), the carrier transport means 22 is activated to return the casting carrier 21 to its first position as illustrated in FIG. 4 in which the carrier 21 and the casting 33 held therein are positioned above the sealant 30 within the air space 32 inside the impregnation chamber 11. After the carrier is returned to this first position, the carrier rotating means 23 is activated so as to rotate the carrier 21 and spin off excess liquid sealant from the casting 33.

(5) Unload step. Upon completion of the sealant spin-off in step (4), the assembly transport means 24 is activated to raise the movable assembly 12 to its first position as illustrated in FIG. 1 wherein the casting carrier 21 is clear of the impregnation chamber 11. After reaching this condition, article transfer means 39, which may comprise a fluid activated ram, is activated to push the casting 33 from the carrier 21 onto a transport conveyor 35′ to the position illustrated by casting 34 in FIG. 1. The conveyor 35′ transports the castings through the remaining stations 3-5 of the impregnation system 1.

The rinse station 3 comprises a closed tank 36 in which the castings may be sprayed or submersed in rinse water, which may be warm water, in order to wash off excess liquid sealant from the castings. Upon completion of a suitable residence time within the tank 36, the conveyor 35′ transports the castings to the enclosed tank 37 which comprises the cure station, wherein the castings are subjected to suitable conditions for curing the particular liquid sealant used in the impregnation system. Typically, heat will be supplied within the tank 37, such as with hot water, oil, electric heating elements, hot air etc., at a temperature sufficient to cure the sealant into a hardened solid or polymerized material. Upon completion of curing, the conveyor 35' transports a casting from the tank 37 to the tank 38 which is an enclosed vessel forming the cooling station. While within the tank 38, the casting may be subjected to cool air if necessary to reduce its temperature to a level suitable for further handling of the part. After exiting the tank 38, the casting may be removed from the conveyor 35' manually, but preferably by suitable automatic material handling equipment and transferred to storage or further use in an assembly line, as the case may be.

(b) Detailed Description

Figure 5:
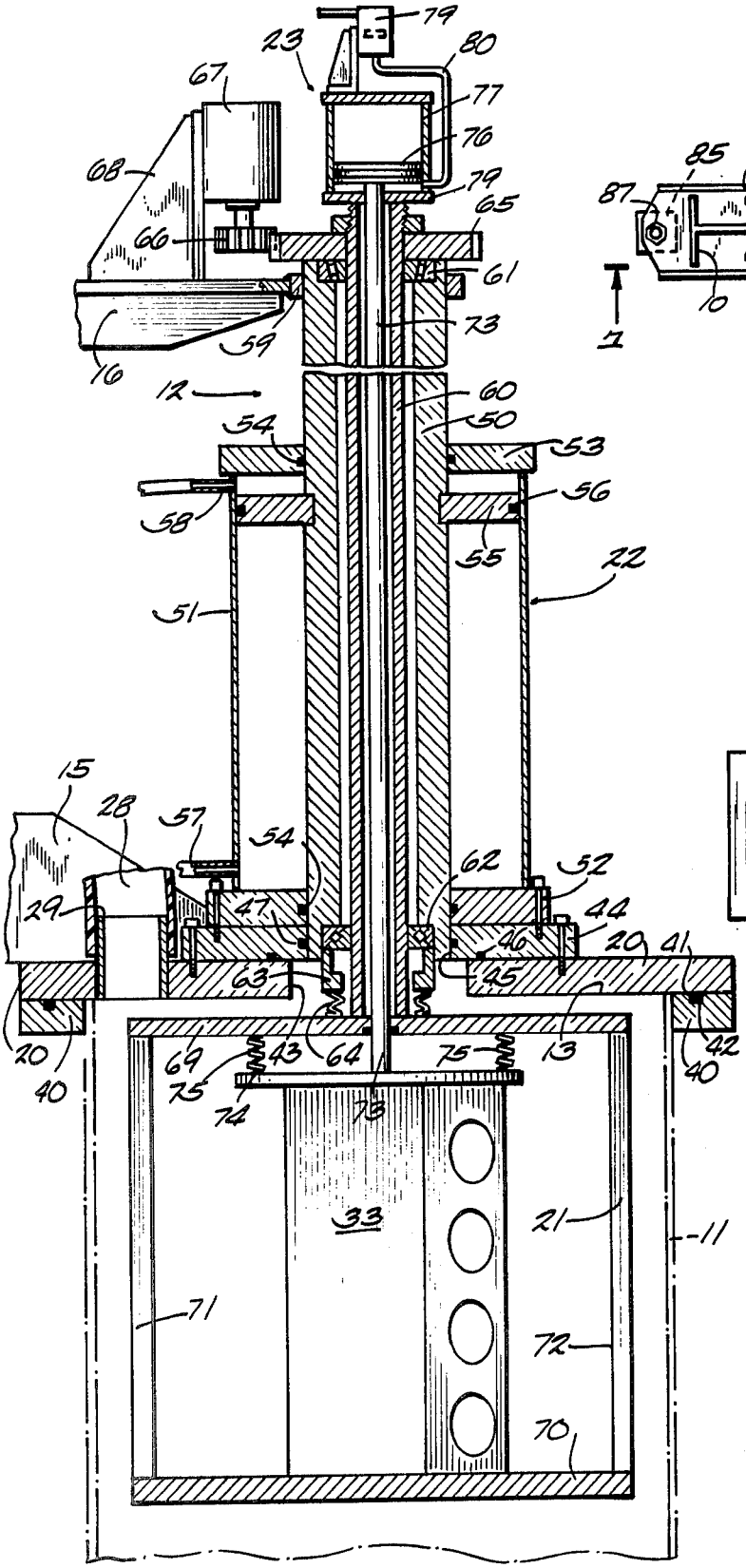
FIG. 5 is a vertical sectional view, with a portion broken away, of the new impregnation apparatus of this invention.

The structure of the impregnation apparatus 2 is illustrated in detail in FIG. 5, which depicts the impregnation chamber 11 and the movable assembly 12. The impregnation chamber 11 includes a circumferential flange 40 surrounding its open end 13, and an O-ring seal 41 is seated in an annular groove 42 formed in the upper face of the flange. The cover means 20 of the movable assembly seats against the flange 40 when it is in the closed or second position of FIG. 5 and FIGS. 2–4 in which position the seal 41 provides a fluid-tight joint between the cover means and the chamber.

The cover means 20 has a central aperture 43. Adapter plate 44 is attached to the cover means, such as by bolts, and has a central aperture 45 which is concentric with the aperture 43. The joint between the adapter plate and cover means is made fluid-tight by O-ring seal 46.

An outer hollow shaft 50 is disposed vertically of the movable assembly 12 and its lower end extends through the central aperture 45 in the adapter plate 44 in a sliding fit therewith. O-ring seal 47 positioned in a groove around the aperture 45 forms a fluid-tight seal between the cylinder 50 and the adapter plate. The lower portion of the outer hollow shaft is surrounded by an activating cylinder 51, which may be an air or hydraulic cylinder connected to a suitable source of fluid, not shown. The base 52 of the cylinder 51 is attached to the adapter plate 44. The hollow shaft 50 extends through the top 53 and base 52 of the cylinder 51 in a sliding-fit therewith, with O-ring seals 54 forming a fluid-tight seal therebetween, the seals being held in grooves formed in the base and top members. A piston 55 is attached to the hollow shaft 50 and fits inside the cylinder 51, with O-ring seal 56 providing a fluid-tight seal between the piston and the interior wall of the cylinder. The cylinder 51 is to be a double-acting cylinder, by which is meant that it is adapted to drive the piston 55 both upwards and downwards, the full up position of the piston being illustrated in FIG. 5. Thus, fluid under pressure when supplied into the cylinder 51 through lower fitting 57 will drive the piston upwards, and when supplied into the cylinder through upper fitting 58 will drive the piston downwards. When the piston 55 is driven upwards, the hollow shaft 50 moves upwards since the piston is attached to it, which condition is also illustrated in FIGS. 2 and 4; conversely, when the piston is driven downwards, the hollow shaft 50 moves downwardly through the aperture 45 in the adapter 44 and aperture 43 in the cover means to be positioned partially inside the impregnation chamber 11 in the position illustrated in FIG. 3.

An inner hollow shaft 60 is arranged axially inside the outer hollow shaft 50. The upper end of the shaft 60 extends above the outer hollow shaft 50 and its lower end extends beyond the bottom of the shaft 50. Along the upper end of the outer hollow shaft 50, an upper radial thrust bearing 61 has one element attached to the inner surface of the shaft 50 and a second element attached to the outer surface of the shaft 60 so as to connect the inner hollow shaft 60 to the outer hollow shaft 50. Similarly, lower radial thrust bearing 62 connects the shafts 50 and 60 together near their bottom portions. The thrust bearings permit the inner hollow shaft 60 to move upwards and downwards in unison with the outer hollow shaft 50; also, however, these bearings permit the inner hollow shaft 60 to rotate within the outer hollow shaft 50, i.e. the shaft 60 is journaled inside the shaft 50. A rotary seal 63 such as a metal-ceramic seal, provides a fluid-tight seal along the bottom of hollow shaft 60 and the shaft 50, and includes a lower element urged against an upper element by springs 64. A gear 65 is attached to the exterior of the inner hollow shaft 60 near its upper end and meshes with the output gear 66 of motor 67, which may be electric, air or hydraulic, that is secured to bracket 68 attached to the upper carriage 16. The upper carriage 16 is attached to a ring 59 which is secured about the exterior of the outer hollow shaft 50 near its upper end. Upon activation of the motor 67, the inner hollow shaft 60 is caused to rotate within and relative to the outer hollow shaft 50.

The casting carrier 21 is illustrated in FIG. 5 as an open yoke-like structure with upper and lower arms 69 and 70, respectively, connected by vertical arms 71 and 72. The open structure is utilized to have minimal blockage of surface areas of casting 33 in order that sealant can reach as much of the surface of the casting as possible during the impregnation step; the upper and lower arms may be perforated or have a screen-like structure to allow sealant to flow through them.

The upper arm 69 of the carrier 21 is attached to the lower end of inner hollow shaft 60, as by welding. A vertical shaft 73 is arranged inside the inner hollow shaft 60 and extends through the upper arm 69 of the carrier 21. A hold-down bracket 74 is connected to the lower end of the shaft 73. Springs 75 are positioned between the bracket 74 and upper arm 69 to bias the bracket into engagement with the casting 33. The upper end of the shaft 73 carries a piston 76 that is enclosed within an actuating cylinder 77 supported on a plate 78 attached to the upper end of the shaft 60. The cylinder 77 may be an air or hydraulic cylinder, and an O-ring seal forms a fluid-tight engagement between the piston 75 and the interior of the cylinder 77. When fluid under pressure from a source, not shown, is admitted through rotary union 79 and line 80 into the cylinder 77 underneath the piston 76, the shaft 73 is driven upwardly from the position illustrated in FIG. 5 so as to retract the hold-down bracket 74 from contact with the casting; this frees a casting from the carrier 21 and facilitates its unloading from the carrier, as well as loading of a casting onto the carrier. When the fluid pressure is released in the cylinder 77, the springs 75 urge the bracket 74 to its hold-down position against the casting. The assembly of the shaft 73 and its associated elements 74–80 thus forms a retractable clamping means for retaining castings in the carrier 21.

Referring now to FIG. 2, the assembly transport means 24 is illustrated therein as including a double acting cylinder 85, such as an air or hydraulic cylinder, mounted on brackets 86 secured to the vertical support 10. The cylinder 85 drives a reciprocable shaft 87 that is connected to the lower carriage 15. As indicated in the detailed view of FIG. 7, the lower carriage 15 includes a pair of spaced members, one on each side of the vertical support 10, and the shaft 87 extends through a holder 88 and is fastened in place by bolt 89. When the shaft 87 of the cylinder 85 is in its retracted position as illustrated in FIGS. 2–4, the movable assembly 12 is in its second or lowered position wherein the cover means 20 closes the open end 13 of the impregnation chamber 11 and the carrier 21 is positioned inside the impregnation chamber above the fluid level 31 of the sealant. When the shaft 87 of the cylinder 85 is in its extended position, the movable assembly 12 is in its first or upper position illustrated in FIG. 1 in which the carrier 21 is raised clear of the open end 13 of the impregnation chamber. The lower carriage 15 is secured to the cover means 20 of the movable assembly and rides along the support 10 when the assembly is transported between these two positions.

The carrier transport means 22 referred to in the general description of part (a) above includes the following elements in the illustrative embodiment of this invention: outer hollow shaft 50, inner hollow shaft 60, and activating cylinder 51. These elements combine to move the casting carrier 21 between a first position in which it is located adjacent the cover means 20 and a second position in which it is located remote from the cover means. After the assembly transport means 24 has been activated to close the impregnation chamber as illustrated in FIG. 2, the carrier 21 is in its first position adjacent to cover means 20 for the dry vacuum step wherein the carrier and castings held thereon are located in the air space 32 above the level 31 of the liquid sealant. Upon completion of the dry vacuum step, the cylinder 51 is activated to drive the piston 55 downwards and thereby move the inner and outer hollow shafts 50 and 60 downwards so that the casting carrier 21 is in its second position in which it is submerged in the liquid sealant 30 for the impregnation step illustrated in FIG. 3. Upon completion of the impregnation step, the cylinder 51 is activated to drive the piston 55 upwardly which raises the inner and outer hollow shafts 50 and 60 to their first position in which the carrier 21 is inside the closed impregnation chamber in the air space 32 above the liquid level 31, as illustrated in FIG. 4. During these two transport movements, the hollow shafts are guided by the upper carriage 16 riding along the vertical support 10.

When in the position of FIG. 4, the carrier rotating means 23, illustrated herein as including the gears 65 and 66 and motor 67 for driving the hollow shaft 60, is activated so as to rotate the inner hollow shaft 60; because the lower end of the shaft 60 is joined to the carrier 21, the carrier is thereby rotated within chamber 11 while in the air space above the liquid sealant so as to spin off excess sealant from the casting 33.

Upon the completion of the spin-off step, the cylinder 85 of the assembly transport means 24 is activated to raise the movable assembly 12 to its first or open position as illustrated in FIG. 1 in which the carrier and any castings thereon are raised clear of the top of the impregnation chamber. When in this position, the cylinder 77 is activated to drive the piston 76 upwardly and thereby raise the hold-down bracket 74 clear of the casting 33; the casting is then ready to be unloaded from the carrier 21 for further processing as described in part (a). While in this position, new castings to be impregnated are loaded onto the carrier 21 and the foregoing steps are repeated.

The operation of the impregnation apparatus 2 is most usefully carried out automatically by employing a suitable control system including a control panel and fluid lines or circuits incorporating solenoid valves (to control of fluid into and out of activating cylinders), microswitches (to sense position) timers, and other well-known control devices to activate the actuating elements in the proper sequence. For example, with reference to the operating steps described previously in part (a), a suitable sequence for automatic control of the apparatus is as follows:

(1) Load Step. Activate cylinder 85 to transport the movable assembly 12 to its first or raised position and activate cylinder 77 to retract hold-down bracket 74; this allows castings to be placed onto the casting carrier 1.

(2) Dry Vacuum Step. Release cylinder 77 to allow springs 75 to urge hold-down bracket 74 into contact with castings on the carrier. Activate cylinder 85 to transport movable assembly to its second or lowered position in which the cover means 20 closes the impregnation chamber 11 and the casting carrier is in its first position adjacent the cover means inside the chamber 11 above the level of liquid sealant in the chamber. Start vacuum pump 6 and run for a sufficient time to develop a selected level of vacuum within the chamber 11.

(3) Impregnation Step. Activate cylinder 51 to transport the casting carrier 22 to its second position in which castings therein are immersed in the liquid sealant in the chamber 11; hold the carrier in such position for a selected length of time to obtain the desired level of impregnation, and then release the vacuum to atmospheric pressure.

(4) Spin-off Step. Activate cylinder 51 to transport the casting carrier to its second position adjacent the cover means and above the level of the liquid sealant in the chamber 11. Activate motor 67 to rotate the carrier while in the air space above the liquid sealant level for sufficient time to drain excess sealant from the castings.

(5) Unload Step. Activate cylinder 85 to move the movable assembly 12 to its first or raised position in which the carrier 21 is clear of the impregnation chamber 11; activate cylinder 77 to retract the hold down bracket 74 and permit removal of castings from the carrier 21. The apparatus is then in condition for loading other castings onto the carrier for impregnation and repetition of the sequence described above.

The adaptability of the impregnation apparatus 2 to the foregoing type of automatic control enables the machine to be used in an impregnation system that can handle castings at a rapid rate and with a minimum of manpower. This advantage also allows the impregnation apparatus to be incorporated with other assembly lines for large scale impregnation. In addition, however, the impregnation apparatus can be operated manually when either relatively small numbers of castings or various types of castings are to be impregnated. Thus, the impregnation apparatus described above may be used with many types of manufacturing processes.

There has thus been described a new apparatus for impregnating metal castings that is adaptable to a wide variety of industrial uses. The apparatus can be incorporated in automated or manually operated systems, and can handle large numbers of identical castings or small runs of different types of castings. Also, it is believed that an impregnation system incorporating the new impregnating apparatus described above will involve a lower capital investment by users than the typical wet vacuum systems now generally used. Operating costs are also expected to be reduced with respect to manpower required to operate the equipment and the cost of materials such as liquid sealant required for impregnation. Another significant advantage is that the impregnation apparatus 2 is more adaptable than prior impregnation apparatus for use with robotics and similar types of automatic devices for handling metal castings, so that castings can be easily fed to the apparatus and transported therefrom with such equipment.

Additionally, the present impregnation apparatus employing a dry vacuum and spin-off of excess sealant within the impregnation chamber is expected to substantially reduce the length of time to impregnate a casting with sealant. The typical wet vacuum impregnation system requires about 10 to 15 minutes for the steps of loading, supplying liquid sealant to an impregnation vessel, loading castings into the sealant, drawing a vacuum on the vessel and then removing the castings from the vessel. There is also an additional time period of about 10 minutes for draining excess sealant from the castings in another vessel. This results in a total cycle time in the range of 20 to 25 minutes for the typical prior art wet vacuum process. In contrast, however, the development work conducted to date indicates the new impregnation apparatus 2 can be operated at much shorter times for the various steps including approximately 15 to 20 seconds for the loading and unloading steps, 30 seconds for developing the vacuum within the chamber under the dry vacuum step (using a vacuum pump with sufficient pumping speed to evacuate the chamber in this amount of time), 30 seconds for the impregnation step, and about 1 minute for the spin-off step. These time factors produce a cycle time of about 2½ minutes to 2 minutes 40 seconds, or about 1/10 the time of the typical wet vacuum process, Also, the development work to date indicates the impregnation apparatus 2 provides porosity sealing results equal to those obtained with the conventional wet vacuum process. Thus, users of the impregnation apparatus 2 are able to obtain significant advantages not attainable with the wet vacuum process and yet achieve effective sealing of castings.

The present invention has been described above with reference to a specific embodiment incorporating its various principals. However, it is anticipated that changes may be made in the exemplary embodiment that would be within the ordinary skill of those working in the field of designing this type of equipment. For example, hydraulic or pneumatic cylinders have been illustrated above for the cylinders 51, 77 and 85; however, either or all of these devices can be replaced with drive units incorporating motors and gears if so desired. Also, the casting carrier 21 has been illustrated as a yoke-like device, but other types of carrier configurations such as a basket structure with open sides can be employed with the apparatus, or castings can be loaded onto a basket having open sides and the basket can be retained in the carrier. These and other modifications to the illustrative embodiment that are within the true spirit and scope of the present invention are intended to be encompassed by the appended claims.

I claim:

1. Apparatus for the impregnation of metal castings with liquid sealant comprising the combination of:

(a) a vertical support member;

(b) an impregnation chamber having an open end and adapted to be partially filled with liquid sealant;

(c) a movable assembly including (1) cover means for closing the open end of the impregnation chamber, (2) a casting carrier, (3) casting carrier transport means, and (4) carrier rotating means for rotating the casting carrier, the movable assembly being arranged for reciprocal movement along the vertical support member;

(d) assembly transport means for transporting the movable assembly between (i) a raised position in which the cover means is spaced from the open end of the impregnation chamber and the casting carrier is in a first position for loading with metal castings to be impregnated and (ii) a lowered position in which the cover means closes the open end of the impregnation chamber; and (e) the casting carrier transport means being adapted to (i) position the casting carrier in a first position near the cover means in which the carrier is located inside the impregnation chamber above liquid sealant therein for the application of vacuum inside the chamber when the movable assembly is in its lowered position, thence (ii) transport the carrier to a second position remote from the cover means in which castings in the carrier are submerged in liquid sealant for impregnation, and (iii) thereafter return the carrier to its first position for rotation upon activation of the carrier rotating means for removal of excess sealant from castings, following which the assembly transport means is activated to transport the movable assembly to its raised position.

2. Impregnation apparatus according to claim 1 in which:

the assembly transport means includes a first fluid cylinder adapted upon activation to transport the movable assembly along the vertical support member between its raised and lowered positions.

3. Impregnation apparatus according to claim 2 further including:

a first carriage adapted to travel along the vertical support member and having a portion connected to the movable assembly, and the first fluid cylinder is secured to the vertical support member and includes a reciprocable shaft connected to the first carriage.

4. Impregnation apparatus according to claim 2 in which:

the carrier transport means includes a second fluid cylinder adapted upon activation to move the casting carrier between its first and second positions.

5. Impregnation apparatus according to claim 4 in which:

the carrier transport means includes an outer hollow shaft and an inner shaft concentric therewith, the inner shaft having a first end attached to the casting carrier, said shafts being connected together for simultaneous movement for transport of the casting carrier between its first and second positions, and the second fluid cylinder is arranged to reciprocally drive the outer hollow shaft for such transport of the casting carrier.

6. Impregnation apparatus according to claim 5 in which:

a piston is secured about the exterior of the outer hollow shaft and arranged within the second fluid cylinder for reciprocal driving of the outer hollow shaft.

7. Impregnation apparatus according to claim 5 in which:

the inner shaft is also journaled within the outer hollow shaft for rotation relative thereto and has a second end portion projecting beyond the hollow shaft, and the casting carrier rotating means includes a motor driving a gear secured to a second end portion of the inner shaft for rotation thereof.

8. Impregnation apparatus according to claim 1 further including:

retractable clamping means arranged to engage and retain castings within the casting carrier and to disengage therefrom for removal of castings from the carrier upon completion of impregnation.

9. Impregnation apparatus according to claim 8 in which:

the retractable clamping means includes a hold-down bracket for engagement with a casting, spring means arranged to urge the hold-down bracket into engagement with a casting, and a fluid cylinder for moving the hold-down bracket out of engagement with a casting.

10. Impregnation apparatus according to claim 1 in which:

the cover means of the movable assembly is supported by a first carriage adapted to travel along the vertical support member, the casting carrier transport means and carrier rotating means are supported by a second carriage adapted to travel along the vertical support member independently of the first carriage when the movable assembly is transported to its lowered position, and a first fluid cylinder is arranged between the first carriage and the support member and adapted to transport the movable assembly between its raised and lowered positions; and the casting carrier transport means includes (i) an outer hollow shaft and an inner shaft concentric therewith and attached to one end to the casting carrier, said shafts adapted for simultaneous axial movement during transport of the casting carrier between its first and second positions, and (ii) a second fluid cylinder adapted to axially transport said shafts for movement of the casting carrier between its first and second positions, and the carrier rotating means includes a motor driving a gear secured to said inner shaft.

11. Impregnation apparatus according to claim 10 wherein:

said inner shaft is hollow, a vertical shaft is arranged inside the inner shaft axially thereof; and a hold-down bracket is attached to one end of the vertical shaft and arranged for engagement with castings on the casting carrier, spring means are arranged between the hold-down bracket and the casting carrier to urge the bracket into engagement with castings on the carrier, and a third fluid cylinder is arranged about the opposite end of the vertical shaft and adapted to move the vertical shaft to disengage the hold-down bracket from castings on the carrier.

12. A method for impregnating metal castings with liquid sealant comprising the steps of:

(1) providing an impregnation vessel partially filled with liquid sealant, (2) loading metal castings inside the vessel in a first position in which they are out of contact with the liquid sealant and then developing a vacuum inside the vessel while the castings are in the first position, (3) moving the metal castings into the liquid sealant for impregnation therewith after a suitable vacuum has been developed inside the vessel, (4) returning the castings to the first position after impregnation with liquid sealant, (5) rotating the castings after being returned to the first position to remove excess liquid sealant therefrom, and thereafter removing impregnated metal castings from the vessel for subsequent curing of the liquid sealant.

* * * * *